US006655117B2

(12) United States Patent
Hoshino

(10) Patent No.: US 6,655,117 B2
(45) Date of Patent: Dec. 2, 2003

(54) ARCH TYPE STRAPPING MACHINE

(75) Inventor: Tetsuya Hoshino, Yokohama (JP)

(73) Assignee: Nichiro Kogyo Co., Ltd., Yokohama (JP)

( * ) Notice: Subject to any disclaimer, the term of this patent is extended or adjusted under 35 U.S.C. 154(b) by 34 days.

(21) Appl. No.: 09/983,301

(22) Filed: Oct. 24, 2001

(65) Prior Publication Data

US 2002/0144489 A1 Oct. 10, 2002

(30) Foreign Application Priority Data

Apr. 9, 2001 (JP) ..... 2001-110233
Apr. 9, 2001 (JP) ..... 2001-110234
Apr. 10, 2001 (JP) ..... 2001-112059
Apr. 10, 2001 (JP) ..... 2001-112060

(51) Int. Cl.[7] ..... B65B 13/04
(52) U.S. Cl. ..... 53/589; 53/399; 53/588; 100/25; 100/26
(58) Field of Search ..... 53/589, 399, 588; 100/25, 26

(56) References Cited

U.S. PATENT DOCUMENTS 3,196,779 A 7/1965 Embree
4,020,756 A * 5/1977 Weiss ..... 100/26
4,155,799 A * 5/1979 Matsushita et al. ..... 156/494
4,569,186 A * 2/1986 Mori et al. ..... 53/589
4,724,659 A * 2/1988 Mori et al. ..... 53/589
4,952,270 A 8/1990 Sakaki et al.
5,083,412 A * 1/1992 Sakaki et al. ..... 53/399
5,155,982 A * 10/1992 Boek et al. ..... 53/589
5,249,518 A 10/1993 Abrams
5,414,980 A 5/1995 Shibazaki et al.
5,513,482 A * 5/1996 Nagashima et al. ..... 53/582
5,615,538 A 4/1997 Miyashita et al.
5,651,306 A * 7/1997 Hoshino ..... 100/26
5,809,873 A * 9/1998 Chak et al. ..... 100/4
6,038,967 A * 3/2000 Chak et al. ..... 100/2
6,073,425 A 6/2000 Chin-Chang et al.
6,415,712 B1 * 7/2002 Helland et al. ..... 100/26

FOREIGN PATENT DOCUMENTS

EP 0 947 426 10/1999

* cited by examiner

*Primary Examiner*—Rinaldi I. Rada
*Assistant Examiner*—Hemant M Desai
(74) *Attorney, Agent, or Firm*—Oblon, Spivak, McClelland, Maier & Neustadt, P.C.

(57) ABSTRACT

An arch type strapping machine suitable for a quick strapping operation and having a long service life is presented.

A sealing mechanism 17 for a strapping band is constituted by a right gripper 45, a left gripper 61 and a compression head 63, wherein the right gripper 45 is operated by a solenoid plunger for fixing 41, and the left gripper 61 and the compression head 63 are operated by the rotation of a cam for fixing 65 and a cam for bonding 67 which are attached to a shaft for sealing 59.

9 Claims, 13 Drawing Sheets

ARCH TYPE STRAPPING MACHINE

BACKGROUND OF THE INVENTION

In a conventional arch type strapping machine, a strapping band is fed to a band guide in an arch member to wind the band around an article to be strapped, and the strapping band is cut and bonded to form a loop, whereby the article is strapped. Such arch type strapping machine is provided with a sealing mechanism for the strapping band. The sealing mechanism comprises a first gripper (hereinbelow, referred to as a right gripper) for fixing a top end of the strapping band fed into the band guide, a second gripper (hereinbelow, referred to as a left gripper) for fixing a rear portion of the strapping band after the band has been pulled back to be tightened and a compression head for compressing and bonding (in many cases, melt-bonding) the top end and the rear portion of the strapping band and cutting the rear portion of the band. The right gripper, the left gripper and the compression head are operated by driving cams attached to a shaft for sealing which is rotated and driven by a motor for sealing.

In the conventional arch type strapping machine, a step for pulling back the strapping band at a high speed and a step for tightening the band at a high torque intervene between the operation of the right gripper and the operation of the left gripper. Accordingly, in the operation of the above-mentioned sealing mechanism, it is necessary that the rotation of the shaft for sealing is once stopped after the right gripper has been operated, and the shaft for sealing is again rotated to cause the operations of the left gripper and the compression head after the step for pulling back the band at a high speed and the step for tightening the band at a high torque have been finished. Accordingly, it is difficult to rotate the shaft for sealing at a high speed whereby a demand of shortening the cycle of strapping can not be satisfied sufficiently. Further, the service life of the sealing mechanism is short because the number of times of temporary stop of the driving system in the sealing mechanism is many.

Further, in a conventional arch type strapping machine, an article is strapped by performing a band feeding step for feeding a strapping band into a band guide in an arch member, a first tightening step for winding the strapping band around an article to be strapped by returning quickly the band fed into the band guide, a second tightening step for tightening strongly the strapping band wound around the article by returning the band, and a step for bonding (in many cases, melt-bonding) a rear portion and a top end of the band wound around the article to be strapped and cutting the band. The band feeding step and the first and second tightening steps are carried out by a driving mechanism comprising a plurality of rollers for running and tightening the strapping band.

Such driving mechanism for the strapping band makes the size of the arch type strapping machine large because a plurality of driving rollers are used, e.g., a driving roller for performing the band feeding step as well as the first tightening step and a driving roller for performing the second tightening step being provided separately. Accordingly, this is contrary to a demand of reducing the size of the arch type strapping machine.

Further, in a conventional arch type strapping machine, an article is strapped with a strapping band in such a manner that the strapping band is fed into a groove formed in a band guide having a channel-like shape in cross section, an open side of which is pushed to an inner surface of the arch member; the strapping band fed into the band guide is wound around the article to be strapped by returning the band at a high speed; the strapping band wound around the article is tightened by pulling it back, and the cutting of a rear portion of the band and bonding (melt-bonding) of the rear portion to an top end of the band is conducted. The returning of the strapping band at a high speed is conducted immediately after the state that the strapping band leaves entirely or partly from the band guide, such state being obtainable by opening forcibly the band guide in a direction departing from the inner surface of the arch member with which the band guide is brought into contact.

The width or the height (in particular, the height) of the groove of the band guide is formed to be relatively small so that the strapping band can be certainly passed without causing the bending of a top end of the band. In the operation for opening the band guide, there is a possibility that the strapping band follows the movement of the band guide due to a frictional force between an inner surface of the groove and the strapping band, and the band remains in the groove. If the strapping band is tightened at a high speed in the state that the strapping band remains in the groove, an unusual deformation is caused instantaneously in the band guide at the time of leaving the strapping band, whereby the band guide is damaged.

Further, in a conventional arch type strapping machine, the strapping band is rewound from a band roll fitted to a band reel which is attached to an outer side of the arch type strapping machine, to be stored temporarily in a band accommodation chamber in the strapping machine. Then, the strapping band in the band accommodation chamber is successively fed into the band guide.

In many cases, the band reel comprises a supporting shaft having an end supported by the main body of the strapping machine, a reed portion attached to the supporting shaft so that at least a part (in many cases, a rear side plate) is removable from the supporting shaft, the reel portion being adapted to mount the band roll for the strapping band, and a nob attached to a rear end of the supporting shaft to fix the reel portion. When a used band roll mounted on the band reel is replaced by a new one, the nob and, for instance, the rear side plate are removed from the supporting shaft; the core member of the used band roll is removed from the reel portion; a new band roll is attached to a reel portion, and then, the rear side plate and the nob are fixed again to the supporting shaft.

In many cases, the structure for fitting the nob to the supporting shaft comprises a male screw formed in a rear end (the free end) of the supporting shaft and a female screw formed in the nob so that the nob can be fitted to the supporting shaft by rotating it several times of turn. Accordingly, in the replacement of the band roll, it is necessary to turn back the tightly fastened nob, and the nob is tightly fastened by rotating after new band roll is mounted. Accordingly, the working for replacing the band roll is troublesome.

SUMMARY OF THE INVENTION

It is an object of the present invention to provide an arch type strapping machine having a sealing mechanism for cutting and bonding a strapping band fed into the band guide of the strapping machine, which is capable of achieving the speed-up of strapping operations and having a long service life.

Further, it is an object of the present invention to provide an arch type strapping machine having a strapping band driving mechanism for feeding the strapping band into the band guide and pulling back the band, which is suitable for reducing the size of the strapping machine.

Further, it is an object of the present invention to provide an arch type strapping machine having a band reel adapted to mount a band roll on which the strapping band fed into the band guide is wound, which permits the fitting and the removal of a nob easily.

Further, it is an object of the present invention to provide an arch type strapping machine having a band driving-out device which can provide a state that the strapping band leaves certainly from a groove for receiving the band at the time of opening the band guide without losing a smooth opening operation of the band guide.

In accordance with an aspect of the present invention, there is provided an arch type strapping machine having a sealing mechanism which comprises a right gripper for fixing a top end of a strapping band fed into a band guide of the arch type strapping machine; a left gripper for fixing a rear portion of the strapping band after the strapping band has been wound around an article to be strapped and tightened; a compression head for compressing and bonding the top end and the rear portion of the strapping band and cutting the rear portion of the band, and a driving means for operating the right gripper, the left gripper and the compression head, said arch type strapping machine being characterized in that the driving means of the sealing mechanism comprises a first driving section for operating the right gripper and a second driving section for operating the left gripper and the compression head, wherein the second driving section comprises a motor for sealing, a shaft for sealing rotated by the motor, a cam for fixing attached to the shaft for sealing to operate the left gripper, and a cam for bonding to operate the compression head.

In accordance with another aspect of the present invention, there is provided an arch type strapping machine having a strapping band driving mechanism which performs a band feeding step for feeding a strapping band into a band guide of the arch type strapping machine, a first tightening step for winding the strapping band around an article to be strapped by returning quickly the strapping band fed into the band guide and a second tightening step for tightening strongly the strapping band around the article by pulling back the strapping band, the arch type strapping machine being characterized in that the strapping band driving mechanism comprises a d.c. motor capable of rotating in a positive direction of feeding and in a reverse direction of returning; a band driving roller attached to an end of an output shaft for band-running of the d.c. motor and a motor for driving a shaft for sealing, connected to the output shaft via an electromagnetic clutch which is attached to the other end of the output shaft of the d.c. motor, wherein the band feeding step is performed by the rotation of the band driving roller caused by the rotation in a direction of feeding of the d.c. motor; the first tightening step is performed by the rotation of the band driving roller which is caused by the rotation in a direction of returning of the d.c. motor, and the second tightening step is performed by the rotation of the band driving roller which is caused by an output of rotation from the motor for driving the shaft for sealing via the electromagnetic clutch.

The output of rotation from the motor fro driving the shaft for sealing, which is transmitted by connecting the electromagnetic clutch is in many cases, an output of a low speed/high torque rotation.

In accordance with another aspect of the present invention, there is provided an arch type strapping machine having a band driving-out device adapted to discharge a strapping band from a band guide when the band guide disposed in an arch member of the arch type strapping machine is opened whereby the strapping band is prevented from remaining in a band groove, the arch type strapping machine being characterized in that the band driving-out device comprises a push pin inserted movably in a through hole formed in a rear portion of the band guide, a pin stopper disposed to oppose a head portion of the push pin, and a spring member disposed between the rear portion of the band guide and the head portion of the push pin so as to push the head portion of the push pin to bring it into contact with the pin stopper.

In accordance with another aspect of the present invention, there is provided an arch type strapping machine having a band reel for a strapping band, the arch type strapping machine being characterized in that the band reel for a strapping band comprises a supporting shaft having an end supported by the main body of the strapping machine, a reel portion attached to the supporting shaft, which is adapted to mount a band roll on which a strapping band fed to a band guide in an arch member of the arch type strapping machine is wound, and a nob attached to a rear end of the supporting shaft to fix the reel portion, wherein the nob has a cylindrical portion fitted to an outer periphery of a rear end of the supporting shaft; the cylindrical portion is provided with a guide groove extending spirally from its front side to its rear side; a recess is formed in the innermost portion of the guide groove, and a pin capable of passing relatively the guide groove to fit to the recess is provided in a rear end portion of the supporting shaft.

The supporting shaft may be such one supported rotatably by the main body of the strapping machine. In this specification, the side of the supporting shaft supported by the main body of the strapping machine is referred to as a front side. The rear end of the supporting shaft is free. The nob for fixing the reel portion may be a cap. The recess may be a groove.

BRIEF DESRIPTION OF THE DRAWINGS

DETAILED DESCRIPTION OF THE INVENTION

In the following, preferred embodiments of the arch type strapping machine of the present invention will be described with reference to the drawings.

Figure 1:
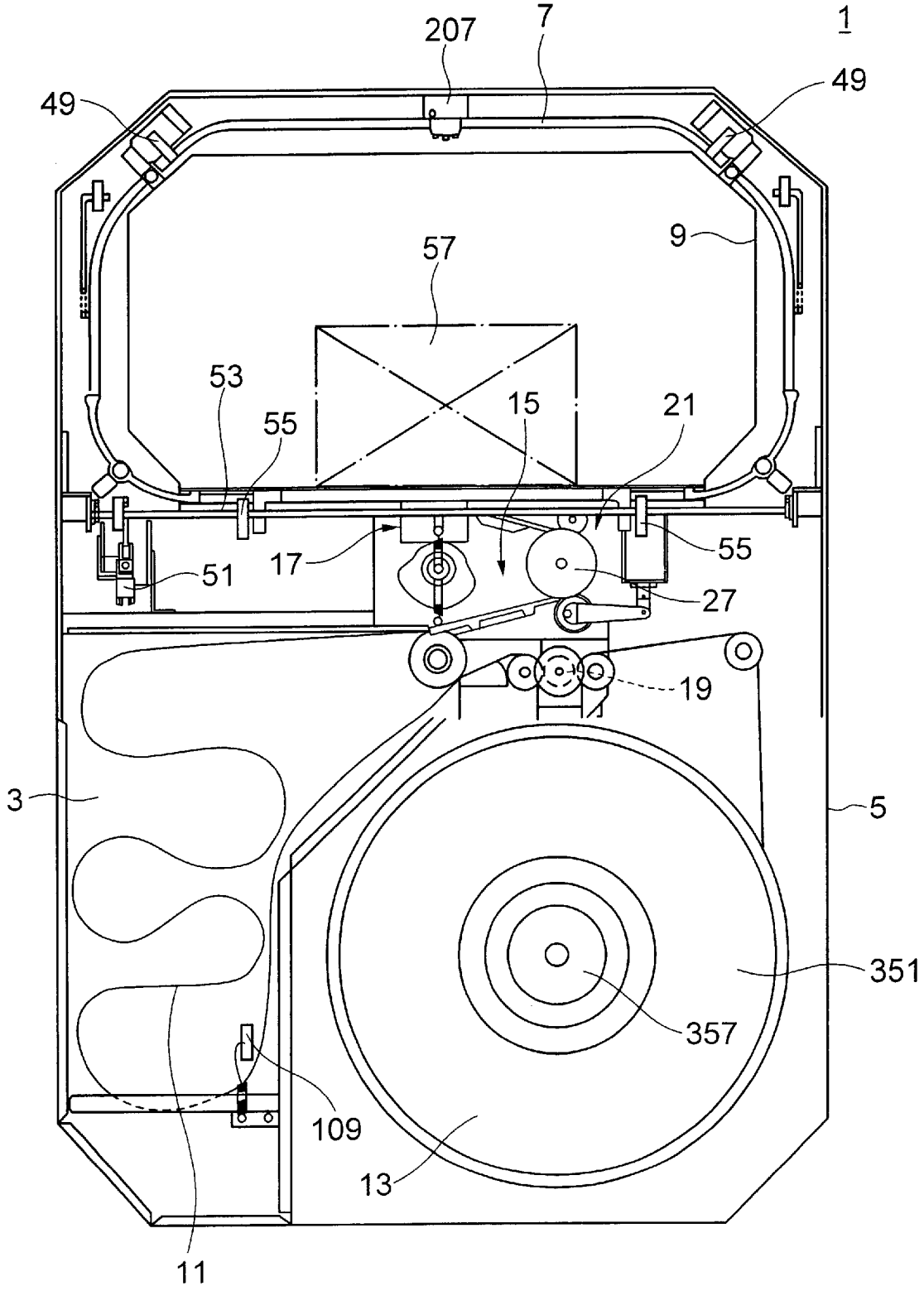
FIG. 1 is a front view showing diagrammatically an inner structure of the arch type strapping machine with a sealing mechanism according to the present invention.
Figure 2:
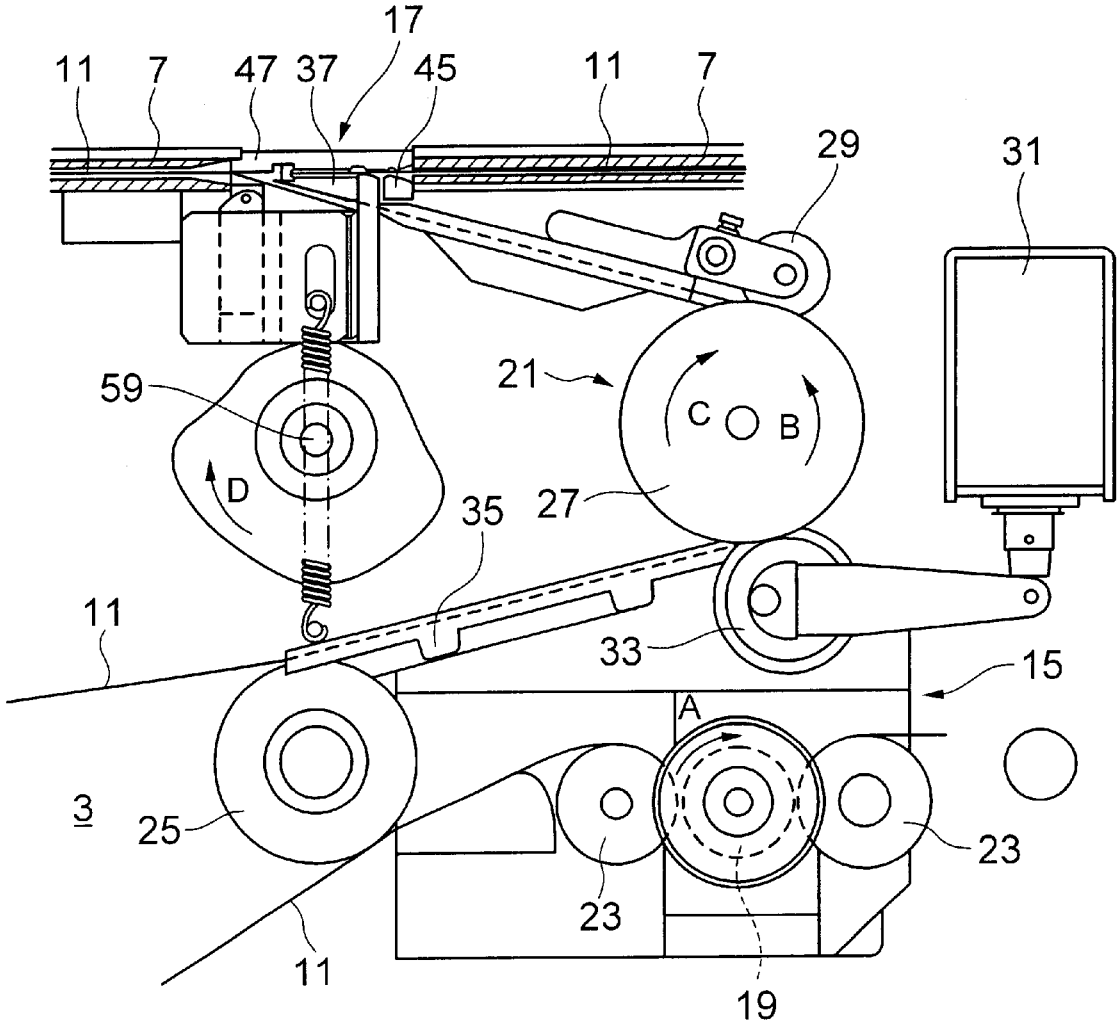
FIG. 2 is an enlarged front view partly cross-sectioned showing a roller unit.
Figure 3:
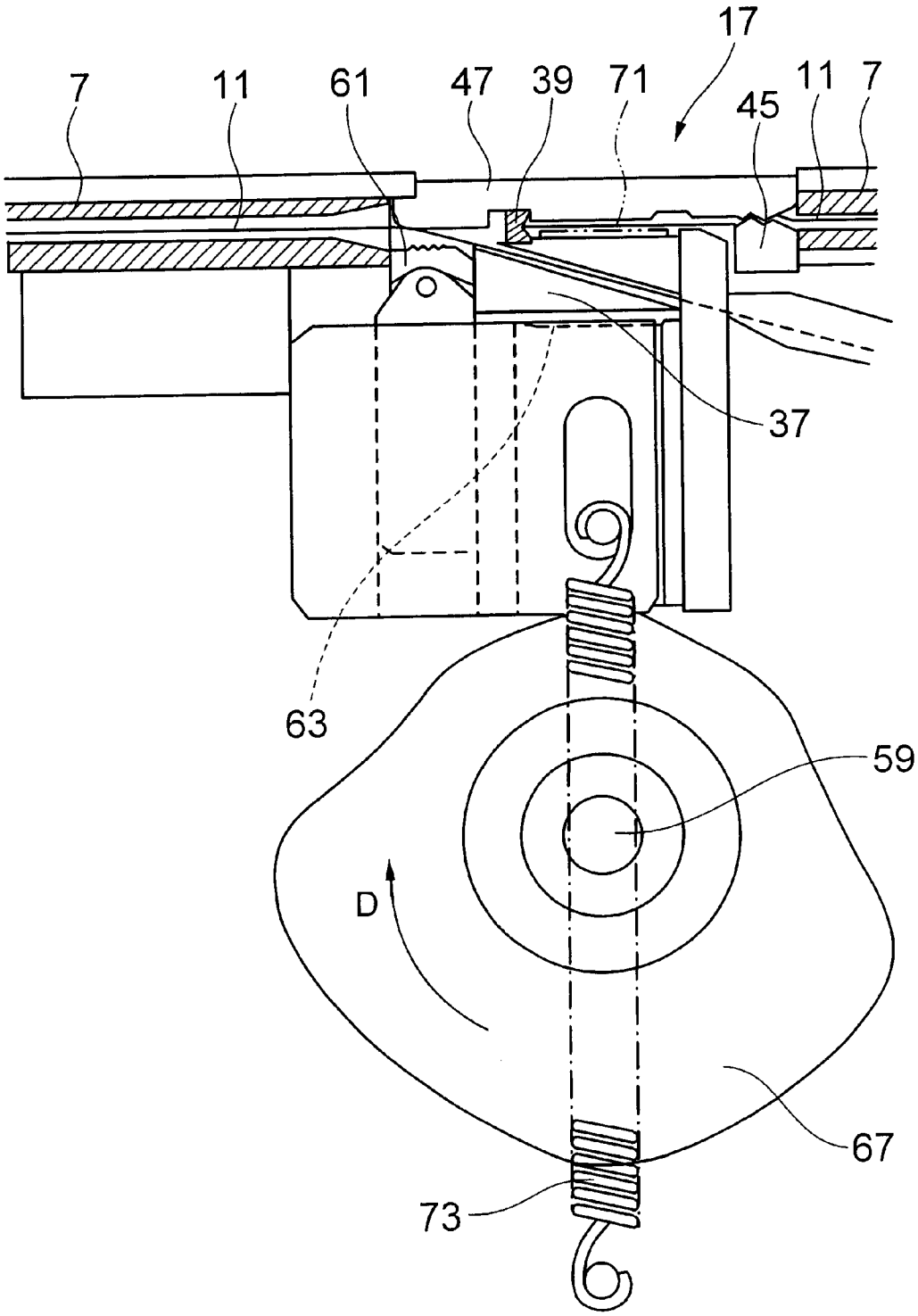
FIG. 3 is an enlarged front view partly cross-sectioned showing the sealing mechanism.

FIG. 1 is a front view showing diagrammatically an inner structure of the arch type strapping machine having a sealing mechanism for a strapping band according to the present invention; FIG. 2 is an enlarged front view showing a roller unit, and FIG. 3 is an enlarged front view showing the sealing mechanism.

An arch type strapping machine 1 comprises a main body 5 in which a band accommodation chamber 3 is formed, an arch member 9 provided on the main body 5 so as to accommodate a band guide 7, a band reel 13 attached to an outer side of the main body 5, on which a band roll (not shown) for a strapping band 11 is mounted, a roller unit 15 disposed in the main body 5 and adapted to feed forward and tighten the strapping band 11, and a sealing mechanism 17 for the strapping band which is disposed in the main body 5 and which cuts and melt-bonds the strapping band 11. The strapping band 11 is rewound from the band reel 13 due to the rotation of a feeding/driving roller 19 in a direction of arrow mark A (i.e., a clockwise direction) in the roller unit 15, to be supplied to the band accommodation chamber 3. Then, the strapping band 11 in the band accommodation chamber 3 is fed to the band guide 7 by means of a strapping band driving mechanism 21 in the roller unit 15.

Figure 4:
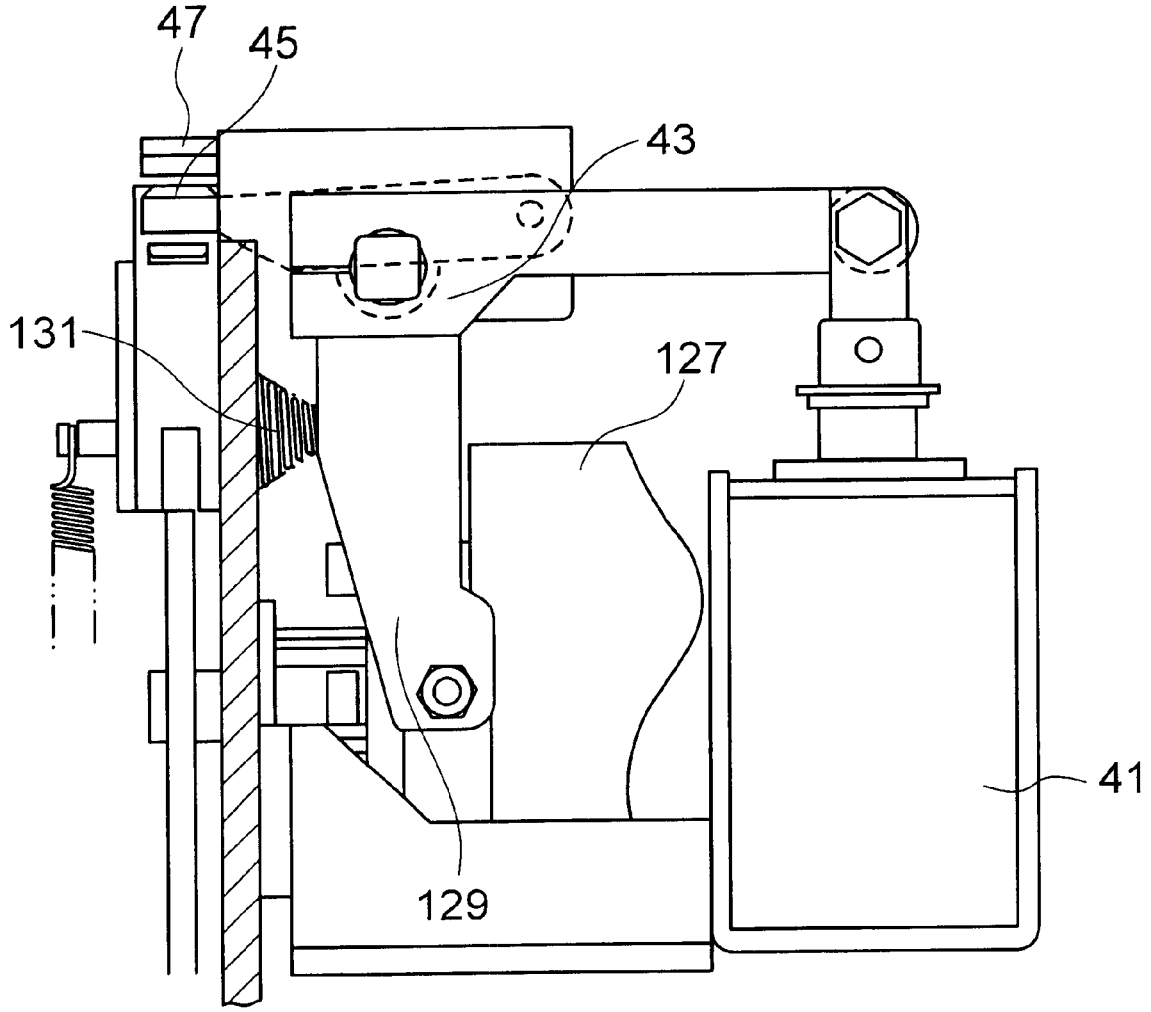
FIG. 4 is a front view showing the structure for operating a right gripper.

A pair of winding rollers 23 are provided at front and rear sides of the feeding/driving roller 19. The strapping band 11 is fed in a snaky movement between each of the winding rollers 23 and the feeding/driving roller 19, passed on a guide roller 25, and supplied to the band accommodation chamber 3. The strapping band driving mechanism 21 comprises a band driving roller 27, a band-running rocker roller 29 disposed at a specified position above the band driving roller 27 to hold the strapping band 11 in association with the band driving roller 27, and a second tightening rocker roller 33 disposed at a specified position below the band driving roller 27 wherein the second tightening rocker roller 33 is moved so as to hold the strapping band 11 in association with the band driving roller 27 when a solenoid plunger for secondarily tightening 31 is operated. In a band feeding step, the strapping band 11, which is extended to the sealing mechanism 17 via the guide roller 25, a guide 35, the band driving roller 27 and the band-running rocker roller 29, is introduced into the band guide 7 through a center guide 37 by the rotation of the band driving roller 27 in a counter clockwise direction (indicated by an arrow mark B) so that a top end of the strapping band 11 is returned to the sealing mechanism 17. When a proximity switch 39 detects that the top end of the strapping band 11 has reached the position of the sealing mechanism 17, the band feeding step is finished, and the rotation of the band driving roller 27 is stopped. The top end of the strapping band 11 returned to the position of the sealing mechanism 17 through the band guide 7 is clamped by a right gripper or a top end gripper 45 (a first gripper) ascended according to a rotating or swinging movement of an L-like lever 43 which is caused by the operation of a solenoid plunger for fixing 41 (a first driving section) and a seal anvil or an iron bed for sealing 47 so that the top end of the strapping band 11 is fixed as shown in FIG. 3 (see FIG. 4 which is a front view showing the structure for operating the right gripper 45. FIG. 4 shows a state that the right gripper 45 descends whereas FIG. 3 shows a state that the right gripper 45 ascends). A solenoid plunger 51 for opening the band guide, an operating shaft 53 and a link 55 constitute a first band guide driving unit. The center guide 37 is unified with the band guide 7 so as not to cause any deflection in the passage for the band.

At substantially the same time of fixing the top end of the strapping band 11, pushing type solenoid plungers 49 for opening the band guide (each constituting a second band guide driving unit) are operated, and the links 55 are operated by the rotation of the operating shaft 53 due to the operation of the solenoid plunger 51 for opening the band guide, whereby the entirety of the band guide 7 including the center guide 37 is moved to be opened in a front direction in FIG. 1. As a result, the strapping band 11 comes off from the band guide 7 by bringing the band guide 7 apart from the arch member 9 (more specifically, an arch plate as an element at one side of the arch member 9).

Subsequent to the opening operation of the band guide 7, the strapping band 11 is pulled back at a high speed by a high speed rotation of the band driving roller 27 in a clockwise direction (indicated by an arrow mark C) so that the strapping band 11 is wound around an article to be strapped 57 (a first tightening step). As soon as the first tightening step is finished, the band driving roller 27 is rotated at a low speed and a high torque in a clockwise direction, and the second tightening rocker roller 33 is moved in a direction coming to contact with the band driving roller 27 due to the operation of the solenoid plunger for secondary tightening 31 so that the strapping band 11 is strongly held between the second tightening rocker roller 33 and the band driving roller 27. Accordingly, the strapping band 11 wound around the article to be strapped 57 is strongly pulled back for tightening (a second tightening step). A rotating type pulse generator (not shown) is mounted on the band-running rocker roller 29. The absence of an output of rotating pulses from the rotating type pulse generator indicates the cease of the rotation of the band-running rocker roller 29. Therefore, the completion of the first tightening step can be confirmed by the detection of the absence of the rotation pulses.

Figure 5:
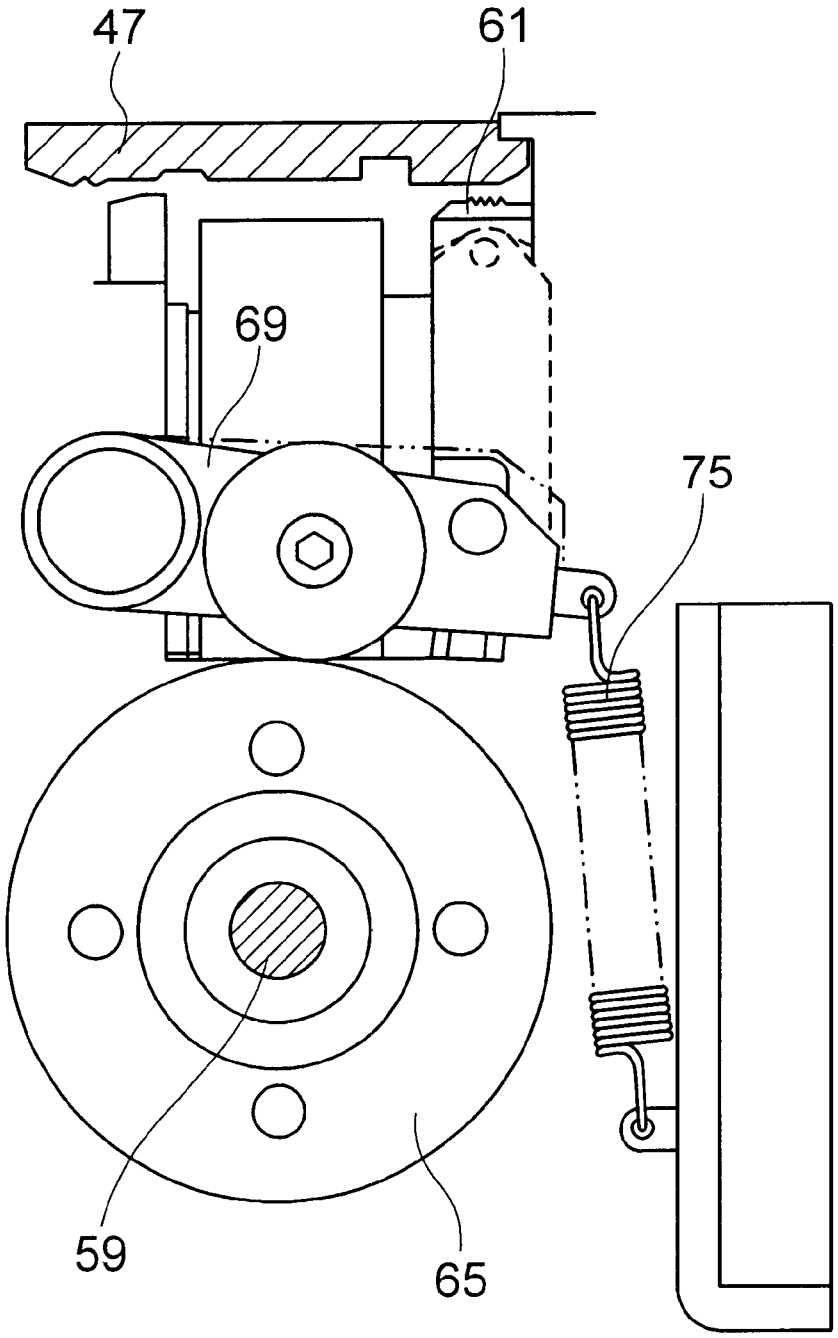
FIG. 5 is a front view showing the structure for operating a left gripper.

In the completion of the second tightening step, a shaft for sealing 59 in the sealing mechanism 17, which extends in a direction perpendicular to the arch member 9, is rotated once at a constant speed in a clockwise direction (indicated by an arrow mark D) in FIG. 3. The sealing mechanism 17 has the right gripper 45, a left gripper or a rear side gripper 61 (a second gripper) and a compression head or a press-cutting head 63. The left gripper 61 and the compression head 63 are operated by the rotation of a cam for fixing 65 and a cam for bonding 67 which are attached to the shaft for sealing 59 (see FIG. 5 showing the structure for operating the left gripper 61). Immediately after the initiation of rotation of the shaft for sealing 59 from its neutral position, the left gripper 61 is moved upward by a swing lever 69 pushed upward by a pushing force of the cam for fixing 65, whereby a rear portion of the strapping band 11 is held and fixed between the left gripper 61 and the seal anvil 47. An upper end of the left gripper 61 has a rough surface, and a lower surface of the seal anvil 47 corresponding to the left gripper 61 has a flat surface, whereby a possibility of damaging or cutting the strapping band 11 in a case that the rear portion of the strongly stretched strapping band 11 is held and fixed, can be eliminated.

A heater 71 is disposed at a position in height between the center guide 37 and the seal anvil 47, or a position having a substantially the same level as an upper end of the center guide 37. The heater 71 is moved forward to a position between the top end and the rear portion of the strapping band 11. When the shaft for sealing 59 is further rotated, the compression head 63 is moved upward by a pushing force of the cam for bonding 67 so as to press the top end of the strapping band 11, the heater 71 and the rear portion of the strapping band 11, in an overlapping state, to the seal anvil 47. Then, the compression head 63 cuts a rear portion of the strapping band 11, and at the same time, it melts the top end and the rear portion of the strapping band 11.

Figure 8:
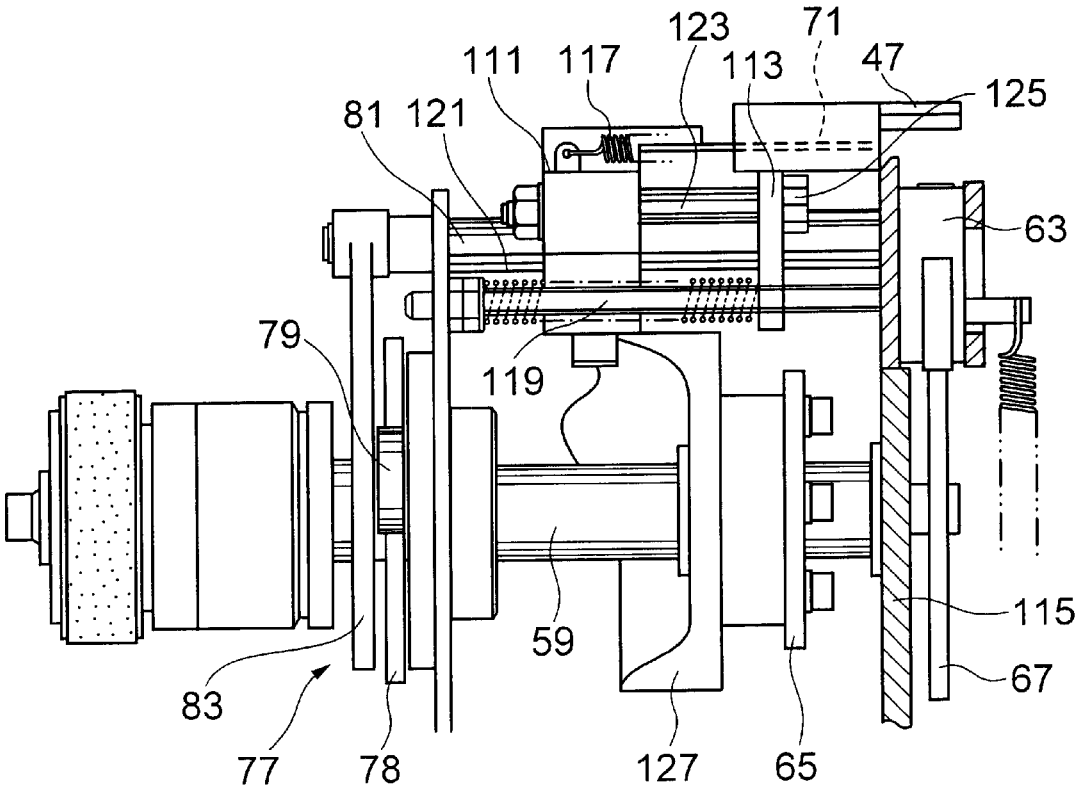
FIG. 8 is a front view showing the structure for operating a seal anvil and a heater.

When the shaft for sealing 59 is rotated further, the compression head 63 is slightly descended along the cam surface of the cam for bonding 67 by a pulling force of a tension coil spring 73, and the heater 71 is retracted to be withdrawn between the top end and the rear portion of the strapping band 11. When the shaft for sealing 59 is rotated further, the compression head 63 is ascended again so that the molten top end and rear portion of the strapping band 11 are pressed and melt-bonded in association with the seal anvil 47. When the shaft for sealing 59 is rotated further, the right gripper 45, the left gripper 61 (which is pulled in a lower direction by a tension coil spring 75) and the compression head 63 are descended; the seal anvil 47 is retracted, and the shaft for sealing 59 is further rotated to a position of 360° rotation (the neutral portion) at which the shaft for sealing 59 is stopped (see FIG. 8 showing a state that the seal anvil 47 is at an advanced position when the shaft for sealing 59 is returned to the neutral position). In FIG. 8, reference numeral 77 designates a position determining device for the shaft for sealing 59. The position determining device 77 comprises a disc 78 attached to the shaft for sealing 59 and a swing arm 83 having a roller 79 in contact with the disc 78 at its intermediate portion and an end connected to a supporting shaft 81. The swing arm 83 is connected with a tension spring (not shown) which urges the swing arm 83 in such a direction that the roller 79 is pushed to the disc 78. When the shaft for sealing 59 is returned to the neutral position, the roller 79 is fitted to a recessed portion (not shown) formed in a portion of the disc 78 by a pulling force of the spring, whereby the shaft for sealing 59 can correctly be stopped at the neutral position.

The article 57 after having been strapped is discharged from the arch type strapping machine 1. Then, an electric current fed to the push type solenoid plunger 49 for opening the band guide and the solenoid plunger 51 for opening the band guide is interrupted, whereby the band guide 7 including the center guide 37 is restored to a state that it is pushed to the arch member 9.

The driving mechanism for the roller unit 15 and the sealing mechanism 17 will be described with reference to FIG. 6 as a plan view and FIG. 7 as a side view.

The band driving roller 27 is attached to an end of the output shaft 87 of a d.c. motor 85. An electromagnetic friction clutch 91 with a pulley 89 is provided on the other end of the output shaft 87. A tooth clutch 95 having a pulley 93 is provided at a rear end of the shaft for sealing 59 which is rotated by a motor 97. The band feeding/driving roller 19 is connected via an electromagnetic clutch 101 to an end of the output shaft 99 of the motor 97 for driving the shaft for sealing. A reduction unit 105 having a pulley 103 is provided at the other end of the output shaft 99. A single driving belt 107 is wound around the pulley 89, the pulley 93 and the pulley 103. In the band feeding step, the strapping band 11 is driven by a high speed rotation of band driving roller 27 which is caused by a high speed rotation of the d.c. motor 85 in a counterclockwise direction, and in the first tightening step, the strapping band 11 is driven by a high speed rotation of band driving roller 27 which is caused by a high speed rotation of the d.c. motor 85 in a clockwise direction. In the second tightening step, the electromagnetic friction clutch 91 is connected to the output shaft 87 of the d.c. motor 85 so that a rotating force of low speed/high torque of the reduction unit 105 connected to the motor 97 is transmitted to the output shaft 87, whereby the strapping band 11 is strongly pulled back by the rotation of low speed/high torque of the band driving roller 27. The adjustment of the second tightening force is conducted by changing a voltage applied to the electromagnetic friction clutch 91. In the completion of the second tightening step, the tooth clutch 95 is connected to the shaft for sealing 59 so that the shaft for sealing 59 is rotated by the motor 97 for driving the shaft for sealing 59. Then, the left gripper 61 is raised to press the strapping band 11. Then, the electromagnetic friction clutch 91 is disconnected, and subsequent to this, the compression head 63 is operated. When the shaft for sealing 59 is rotated continuously by 360°, a sealing step is finished. In this case, when the fact that the shaft for sealing 59 is returned to the neutral position after the rotation of 360°, the tooth clutch 95 is disconnected, and the rotation of the motor 97 for driving the shaft for sealing is stopped.

When a band quantity sensor 109 detects that the quantity of the strapping band 11 in the band accommodation chamber 3 decreases to a predetermined level, the electromagnetic clutch 101 is connected to the output shaft 99 of the motor 97 for driving the shaft for sealing 59 so that the band feeding/driving roller 19 is rotated by a driving force from the motor 97 for driving the shaft for sealing 59, and the strapping band 11 is rewound from the band reel 13 so as to supply the band into the band accommodation chamber 3.

The mechanism for operating the seal anvil 47 and the heater 71 will be described with reference to FIG. 8 and FIG. 6.

Figure 6:
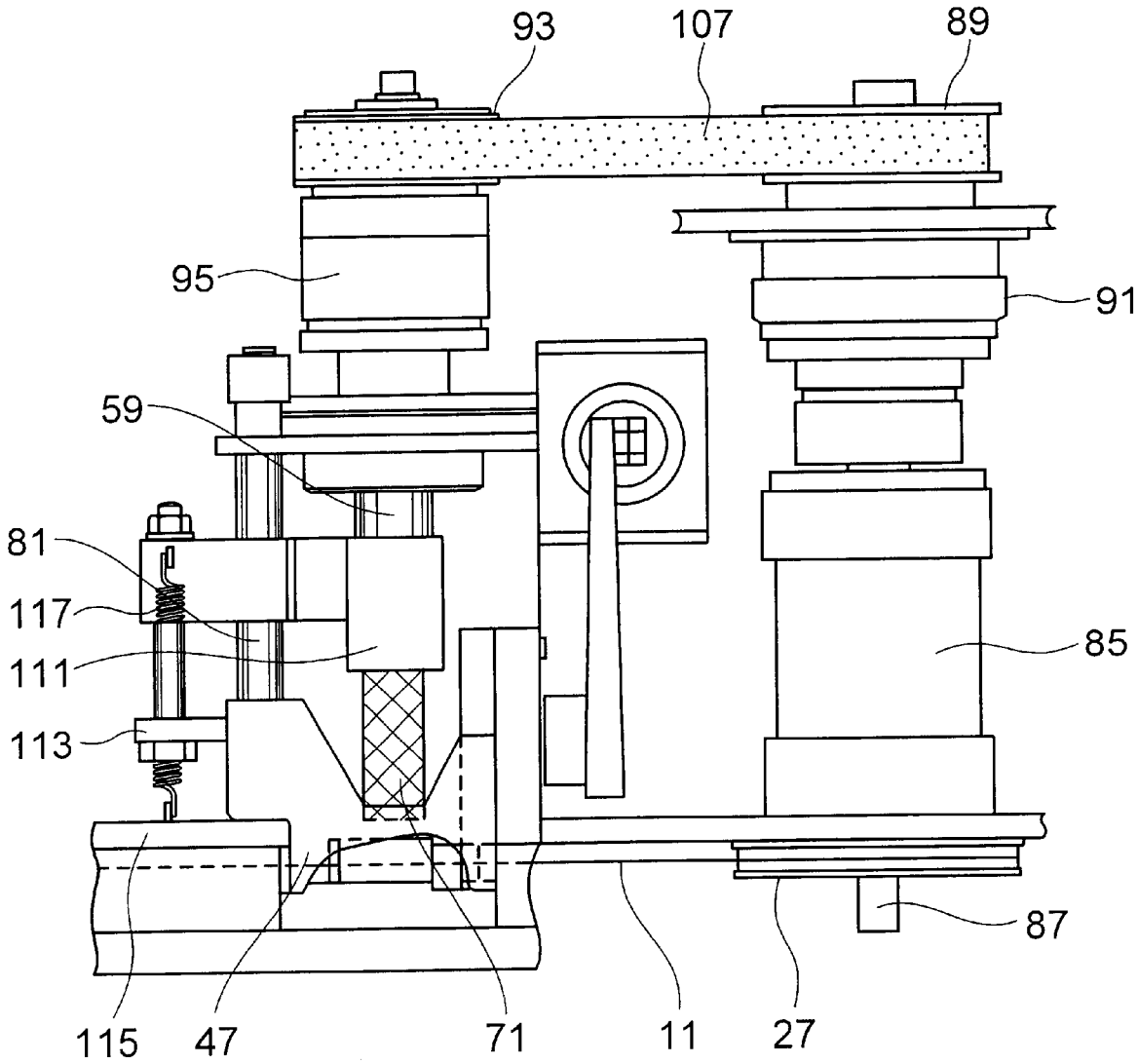
FIG. 6 is a plan view showing the structure for driving the roller unit and the sealing mechanism.
Figure 7:
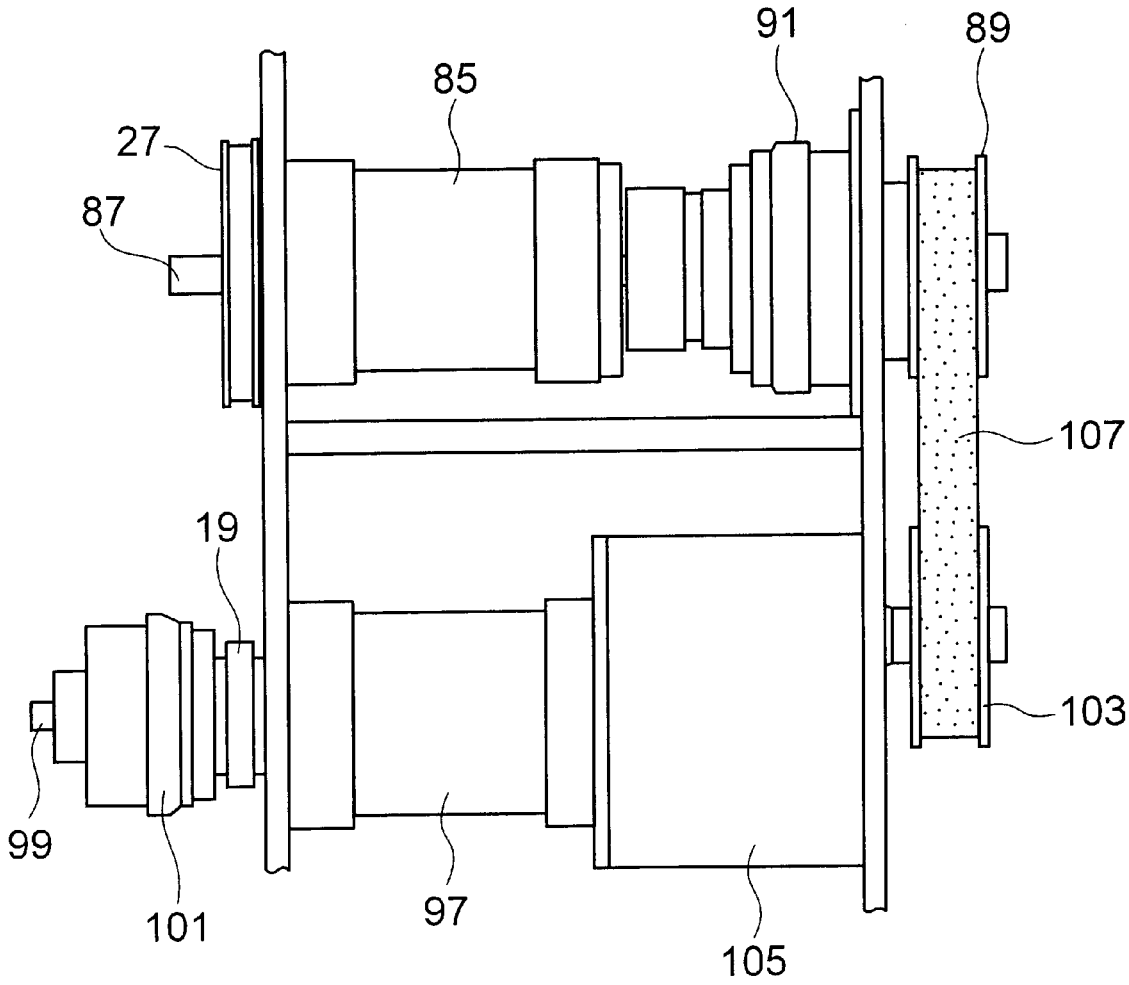
FIG. 7 is a side view showing the structure for driving the roller unit and the sealing mechanism.

The heater 71 is attached to a heater supporting member 111 which is attached in a manner capable of sliding to a supporting shaft 81 which is extended in a direction of front and back, i.e., a direction of moving the heater 71 (FIG. 6). Further, the seal anvil 47 is attached to a supporting member 113 which is attached in a manner capable of sliding to the supporting shaft 81 at a front side with respect to the heater supporting member 111 (FIG. 6). A tension coil spring 117 is extended between the heater supporting member 111 and a supporting plate 115 of the arch type strapping machine 1 so that the heater supporting member 111, hence, the heater 71 is always pulled in a front direction. The supporting member 113 is attached in a manner capable of sliding to a pressing shaft 119, and a compression coil spring 121 is located between a rear end of the pressing shaft 119 and the supporting member 113, whereby the supporting member 113, hence, the seal anvil 47 is always pushed in a front direction. A connecting rod 123 is attached to the heater supporting member 111. The connecting rod 123 is inserted in a manner capable of sliding in a hole formed in the supporting member 113, and has a head for pulling 125 at its top end. The heater supporting member 111 is adapted to move in a direction of front and back along a cam surface which is formed at a rear end of a cylindrical cam 127 attached to the shaft for sealing 59. FIG. 8 shows a state before the initiation of rotation of the shaft for sealing wherein the seal anvil 47 is advanced and the heater 71 is retracted. In such state, when the shaft for sealing 59 is rotated at substantially the same time of the completion of the second tightening step, the left gripper 61 is raised, and subsequent to this, the heater supporting member 111 is moved in a front direction along the cam surface of the cylindrical cam 127 by a pulling force of the tension coil spring 117, and then, the heater 71 is moved between the rear portion and the top end of the strapping band 11. The seal anvil 47 is prohibited to move forward beyond the position as indicated in FIG. 8.

When the shaft for sealing 59 is rotated further, the heater supporting member 111 is moved in a rear direction by the cam surface of the cylindrical cam 127, whereby the heater 71 is also retracted. However, the seal anvil 47 is remained at the advanced position. When the heater supporting member 111 is retracted further by the pushing force of the cam surface of the cylindrical cam 127 with the rotation of the shaft for sealing 59, the supporting member 113 is moved in a rear direction by a pulling force of the connecting rod 123, and therefore, the seal anvil 47 is moved backward. When the shaft for sealing 59 is rotated further, the heater supporting member 111 is moved forwardly along the cam surface of the cylindrical cam 127, and the supporting member 113 is also moved forwardly by a pushing force of the compression coil spring 119. Then, the seal anvil 47 and the heater 71 are restored to the state as shown in FIG. 8 by the rotation of 360° of the shaft for sealing 59.

The cylindrical cam 127 has also a cam surface at its front end, which as soon as the initiation of the rotation of the shaft for sealing 59, operates a vertically extending portion 129 of the L-like lever 43 to maintain the right gripper 45 at an elevated position (see FIG. 4), whereby an electric current to the solenoid plunger for fixing 41 is interrupted. Just before the completion of the rotation of 360° of the shaft for sealing 59, the L-like lever 43 is rotated in a direction of raising along the cam surface formed at the front end of the cylindrical cam 127 by a pushing force of a spring 131 to return to the original position, and the right gripper 45 is lowered.

In the above-mentioned embodiment, the first driving section and the second driving section are respectively constructed so as to operate separately. The right gripper is operated by the first driving section, and then, the second driving section is operated. The second driving section comprises the motor for sealing, the shaft for sealing, and the cam for fixing and the cam for bonding which are attached to the shaft for sealing. The left gripper and the compression head are operated sequentially by the continuous rotation of 360° of the shaft for sealing which is caused by the motor for sealing. The source for driving the first driving section is generally separate from the motor for sealing as the source for driving the second driving section. The right gripper is not always necessary to be operated by the first driving section. The first driving section is to cause an initial operation of the right gripper. Another driving section may be provided to maintain the initial operation and may perform the subsequent operations for the right gripper.

In a case of opening forcibly the band guide, a cam is usually provided on the shaft for sealing so that the band guide is opened by the rotation of the shaft for sealing. However, the band guide has to be maintained in an opening state at least until the completion of the strapping band pulling step. Accordingly, it is necessary for the above-mentioned structure to stop once the shaft after the rotation of the shaft for sealing, and then, to rotate again the shaft. Therefore, in order to open forcibly the band guide, another driving section for the band guide may be provided separate from the second driving section. A solenoid plunger may be used for the first driving section and the driving section for the band guide.

Further, in the above-mentioned embodiment, the band driving roller is driven by the motor in order to perform directly the band feeding step, the first tightening step and the second tightening step.

In order to reduce the size of the arch type strapping machine, it is preferred to feed the strapping band into the band accommodation chamber by providing a band feeding/driving roller on one side of the output shaft of a motor via an electromagnetic clutch and providing a reduction unit on the other side of the output shaft wherein the band feeding/driving roller is rotated by the connection of the electromagnetic clutch, and to conduct the second tightening step by the rotation of the band driving roller due to a rotating force from the reduction unit. Further, it is effective to use the above-mentioned motor to operate the sealing mechanism (including a part of the sealing mechanism) for cutting a rear portion of the strapping band wound around an article to be strapped, and then, bond (or melt-bond) the rear portion to the top end of the strapping band. In many cases, the motor is to rotate the shaft for sealing to which a driving cam is attached. Or, the motor for driving the sealing mechanism may be used for a source for conducting the second tightening step so that an output of rotation of the motor is transmitted to the band driving roller.

Figure 10:
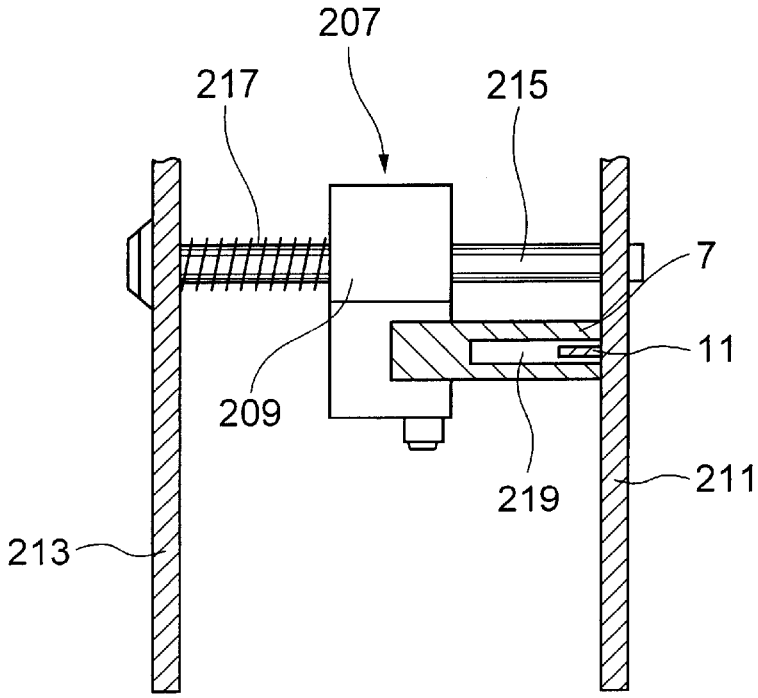
FIG. 10 is a plan view partly cross-sectioned showing an upper supporting device in detail.
Figure 11:
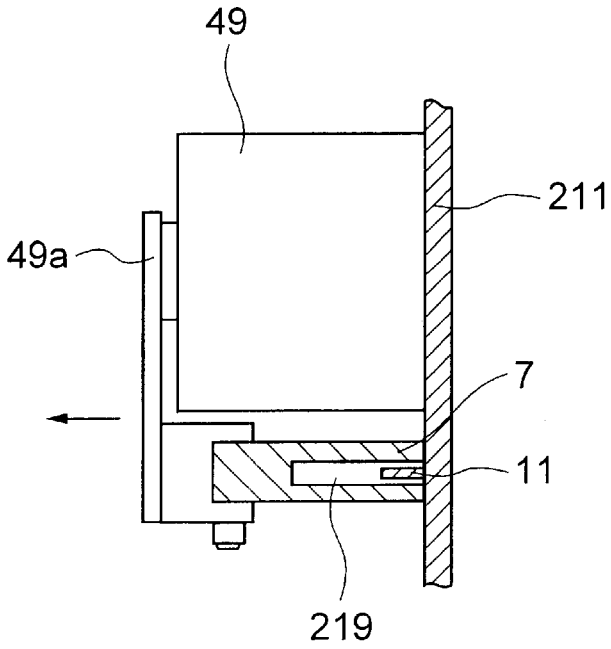
FIG. 11 is a plan view showing a pushing type solenoid plunger for opening the band guide.

Another embodiment of the present invention will be described with reference to FIGS. 9 to 11.

Figure 9:
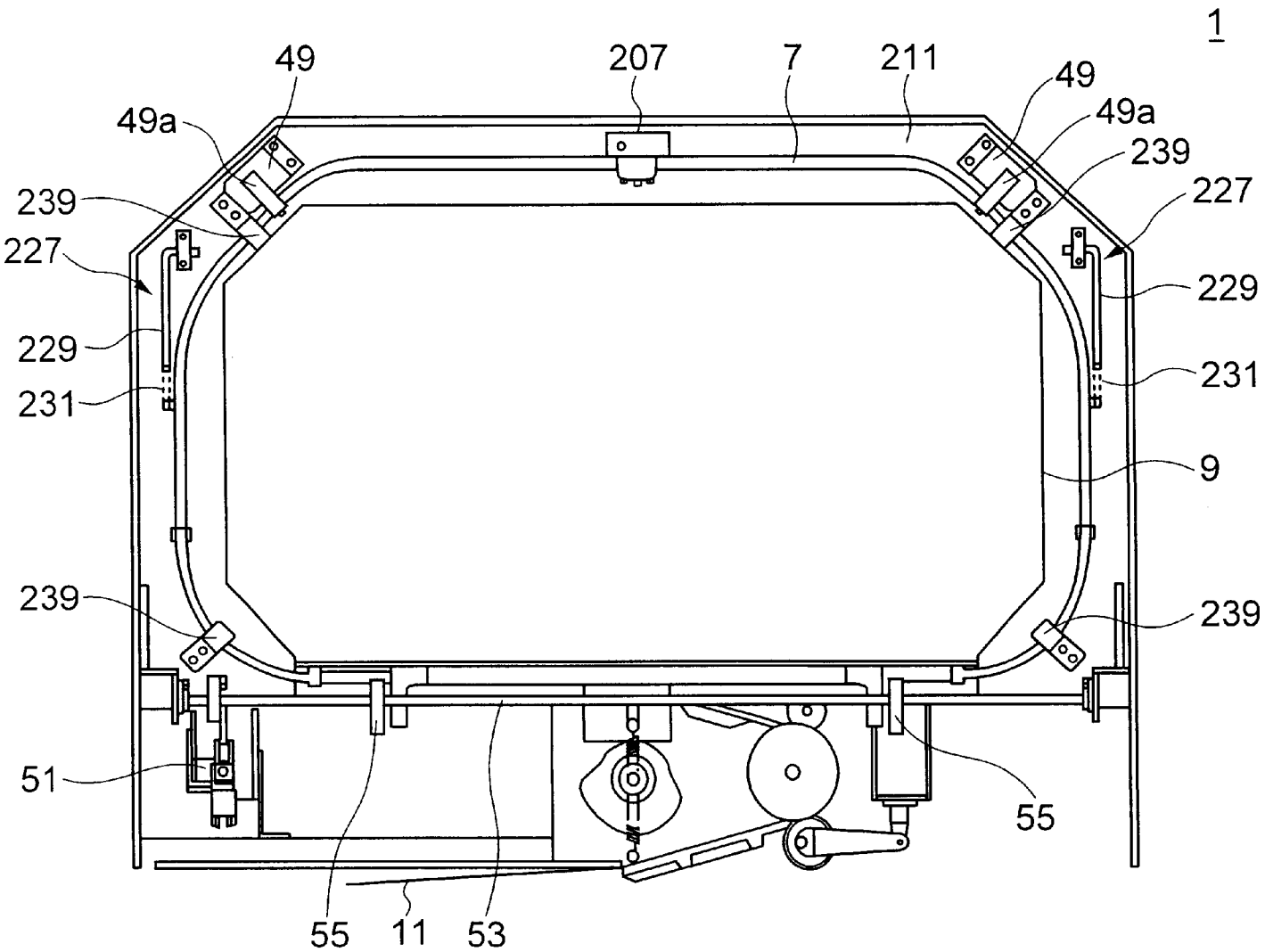
FIG. 9 is a front view showing diagrammatically a band guide of the arch type strapping machine with a band driving-out device according to the present invention.

FIG. 9 shows diagrammatically a band guide 7 of the arch type strapping machine 1 provided with band driving-out devices 239 for a strapping band according to the present invention; FIG. 10 is a plan view partly cross-sectioned showing an upper supporting device in detail, and FIG. 11 is a plan view partly cross-sectioned showing a pushing type solenoid plunger for opening the band guide.

The band guide 7 having a channel-like shape in cross section is arranged in a loop form along the arch member 9 of the arch type strapping machine 1, and an upper central portion of the band guide 7 is supported by the upper supporting device 207. The upper supporting device 207 comprises a movable supporting member 209 located at an upper central portion of the band guide 7, a guide rod 215 attached to a first arch plate 211 (a front side arch plate) of the arch member 9 and a second arch plate 213 (a rear side arch plate) of the arch member 9 in its upper portion to extend horizontally or in parallel to a front/rear direction, i.e., in a width direction of the band guide 7 and to support the movable supporting member 209 in a manner capable of sliding, and a compression coil spring 217 wound on the guide rod 215 between the second arch plate 213 and the movable supporting member 209. With this, the band guide 7 is in such a state that a side of the opening of a groove 219 of the channel-like band guide 7 is pressed to the first arch plate 211 by a spring action of the compression coil spring 217. In this state, the strapping band 11 is movable in the groove 219. When the band guide 7 is opened, the movable supporting member 209 is urged together with the band guide 7 in a rear direction, i.e., the band guide 7 being moved in a direction aparting from the first arch plate 211, along the guide rod 215 against the spring action of the compression coil spring 217. The groove 219 is preferably formed to be thin. Accordingly, a lower wall of the band guide 7 in FIG. 10 on which the band slips, is formed to be slightly thin so that the withdrawal of the band 11 can be smooth even when the band drags on the inner surface of the groove 219.

Pushing type solenoid plungers 49 for opening the band guide are fixed to the first arch plate 211 at the second and third corner portions of the arch member 9 respectively. An operating portion 49*a* of each of the pushing type solenoid plungers 49 is attached to the band guide 7. When the pushing type solenoid plungers 49 are operated wherein each of the operating portions 49*a* is moved in a direction of an arrow mark in FIG. 11, the band guide 7 is pulled by the operating portions 49*a* so that the band guide 7 is moved to be opened in a direction aparting from the first arch plate 211.

In FIG. 9, a pair of return spring members 227 are provided at both sides of the band guide 7. Each of the return spring members 227 is constituted by a stick 229 and a tension coil spring 231 connected to a lower end of the stick 229 wherein an upper end of the stick 229 is attached to the first arch plate 211 in a rotatable manner, and a lower end of the tension coil spring 231 is attached to an outer side of the band guide 7.

Below the arch member 9, the operating shaft 53 is disposed in a rotatable manner along a lower portion of the band guide 7. The operating shaft 53 and the lower portion of the band guide 7 are connected by means of the link 55. An end portion of the operating shaft 53 is connected to the solenoid plunger 51 for opening the band guide 7. By the operation of the solenoid plunger 51, the operating shaft 53 is rotated to open the band guide 7 via the link 55. The lower portion of the band guide 7 is pushed by a spring (not shown) toward the first arch plate 211.

Accordingly, when the pushing type solenoid plungers 49 and the solenoid plunger 51 are operated simultaneously, the band guide 7 is moved in its entirety to perform an opening operation in a direction aparting from the first arch plate 211. The arch member 9 is provided with a pair of band driving-out devices 239 each of which prevents the strapping band 11 from following the movement of the band guide 7 and remaining in the groove 219 of the band guide 7 when the band guide 7 is subjected to the opening operation.

Figure 12:
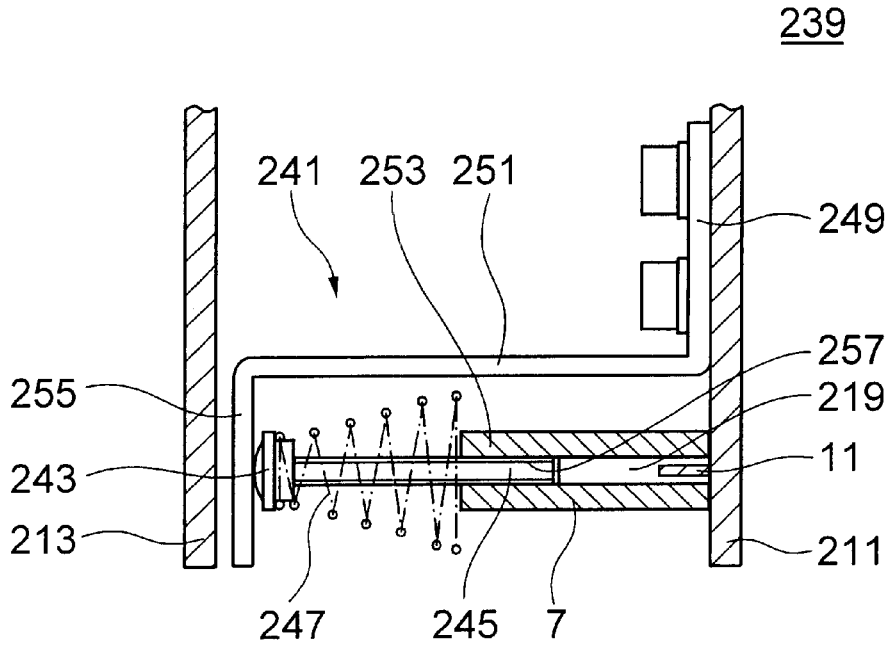
FIG. 12 is a plan view partly cross-sectioned showing the band driving-out device in detail wherein a state before opening the band guide is shown.
Figure 13:
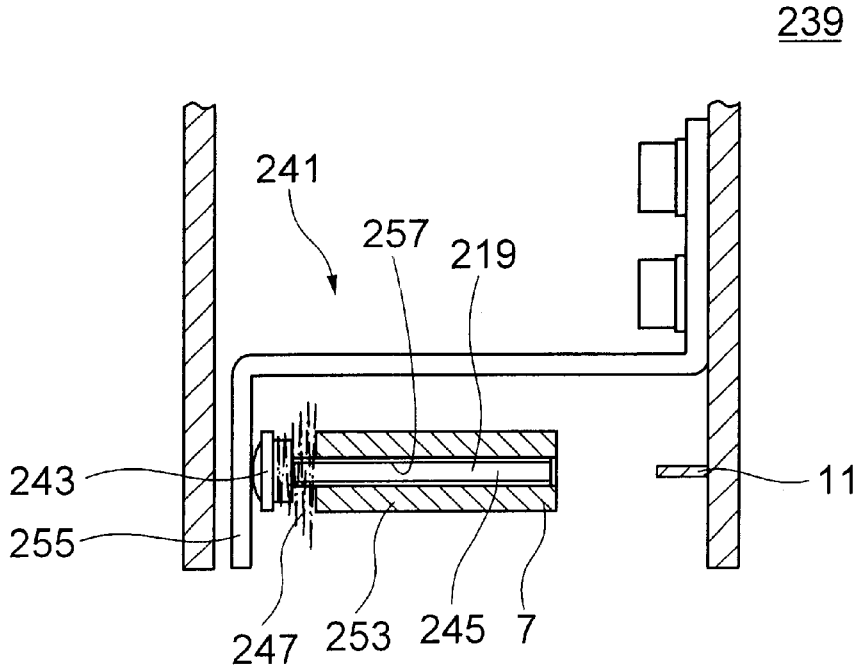
FIG. 13 is a plan view partly cross-sectioned of the band driving-out device wherein a state after opening the band guide is shown.

FIG. 12 is a plan view partly cross-sectioned of a band driving-out device in detail wherein a state before the opening of the band guide 7 is shown, and FIG. 13 shows a state after the opening of the band guide 7.

Each of the band driving-out devices 239 is provided at lower corner portions of the arch member 9, and comprises a pin stopper 241 made of a metallic plate, a push pin 245 having a head portion 243 at its rear end and a compression coil spring 247. The pin stopper 241 has an integral body comprising a fixing portion 249 fixed to the first arch plate 211, a portion 251 having a larger width than the band guide 7, which extends from an end of the fixing portion 249 in a rear direction, i.e., in a width direction of the band guide 7 and a rear portion 255 which is contiguous to the other end (a rear end) of the portion 251 and which extends in parallel to the arch member 9 or the first and second arch plates 211, 213 to a position behind a rear portion 253 of the band guide 7.

A through hole 257 is formed penetrating the rear portion 253 of the band guide 7 to reach the groove 219. The push pin 254 is inserted in the through hole 257 from its top end side in a manner capable of sliding. The compression coil spring 247 is fitted to the push pin 245 so as to be interposed between a rear surface of the band guide 7 and the head portion 243 of the push pin 245, whereby the head portion 243 of the push pin 245 is always pressed toward the rear portion 255 of the pin stopper 241 to be in contact with the rear portion 255. Before the opening operation of the band guide 7, the band guide 7 is pressed to the first arch plate 211 by the compression coil spring 247, and the top end of the push pin 245 is around the top end side of the through hole 257 so as not to enter into the groove 219. When the opening operation of the band guide 7 is started against the spring action of the compression coil spring 247, the top end of the push pin 245 enters into the groove 219 and is advanced relatively to the position of the opening of the groove 219 in a state that the band guide 7 is fully opened. Accordingly, the strapping band 11 is driven out from the groove 219 by means of the push pin 245 even when the band 11 tends to follow the movement of the band guide 7. Thus, the strapping band is in a state of being drawn entirely from the band guide 7 in the completion of the opening operation of the band guide 7.

After the strapping band 11 has been pulled back at a high speed, followed by tightening strongly, cutting the rear portion and melt-bonding the rear portion to the top end, the feeding of electric current to the pushing type solenoid plungers 49 and the solenoid plunger 51 is stopped, whereby the band guide 7 is restored to be a state of being in contact with the first arch plate 211 by the spring actions of the compression coil spring 217 on the upper supporting device 207, the return spring members 227, the compression coil spring 247 of the band driving-out devices 239 and other springs.

In the above-mentioned embodiment of the present invention, the through hole is formed to penetrate the rear surface of the band guide to reach the groove. When the band guide is pressed to the inner surface of the first arch plate, namely, the head portion of the push pin is pressed to the pin stopper by the spring, the top end of the push pin does not enter into the groove, or is inserted slightly. Accordingly, there is little possibility that the movement of the strapping band in the groove of the band guide is hindered by the push pin.

When the band guide is operated to be opened by the spring action in a direction aparting from the inner surface of the first arch plate, i.e., in a direction that the opening of the groove is apart from the inner surface of the first arch plate in a state that the strapping band is supplied into the groove of the band guide, the top end of the push pin enters deeply into the groove so that the strapping band or a band portion which tends to follow the movement of the band guide, is driven out from the groove. Since the push pin is merely brought into contact with the pin stopper, namely, the push pin is capable of sliding with respect to the pin stopper, there is little possibility of causing a trouble in the opening operation of the band guide even when the band guide shakes in the opening operation to increase a frictional force between the push pin and the band guide.

The spring member in the band driving-out devices functions to bring the push pin into contact with the pin stopper when the band guide is returned to the original position. Further, this spring member provides generally a returning force or a substantial auxiliary returning force to the band guide. Usually, the spring member acts on the band guide to provide a pushing force or an auxiliary pushing force against the inner surface of the first arch plate. It is preferable that the spring force of the spring member is such an extent that a contact pressure between the head portion of the push pin and the pin stopper is not too excessive, and the push pin can smoothly slide toward the pin stopper when the band guide is operated for opening. By using the compression coil spring fitted around the push pin as the spring member, the structure of the band driving-out device can be simple. The band driving-out devices of the present invention are preferably located at such positions that the strapping band can follow a forcibly opening operation of the band guide, for example, at corner portions of the arch member or the band guide.

The pin stopper may be such one fixed to the arch member. However, the arch plate at the opposite side of the arch plate to which the band guide is pressed can be used as it is.

In the following, another embodiment of the present invention will be described with reference to the drawings. The general structure and the operation of the arch type strapping machine provided with a band reel for a strapping band of this embodiment are the same as the description based on FIGS. 1 to 8 concerning the first embodiment, and therefore, the description is omitted.

Figure 14:
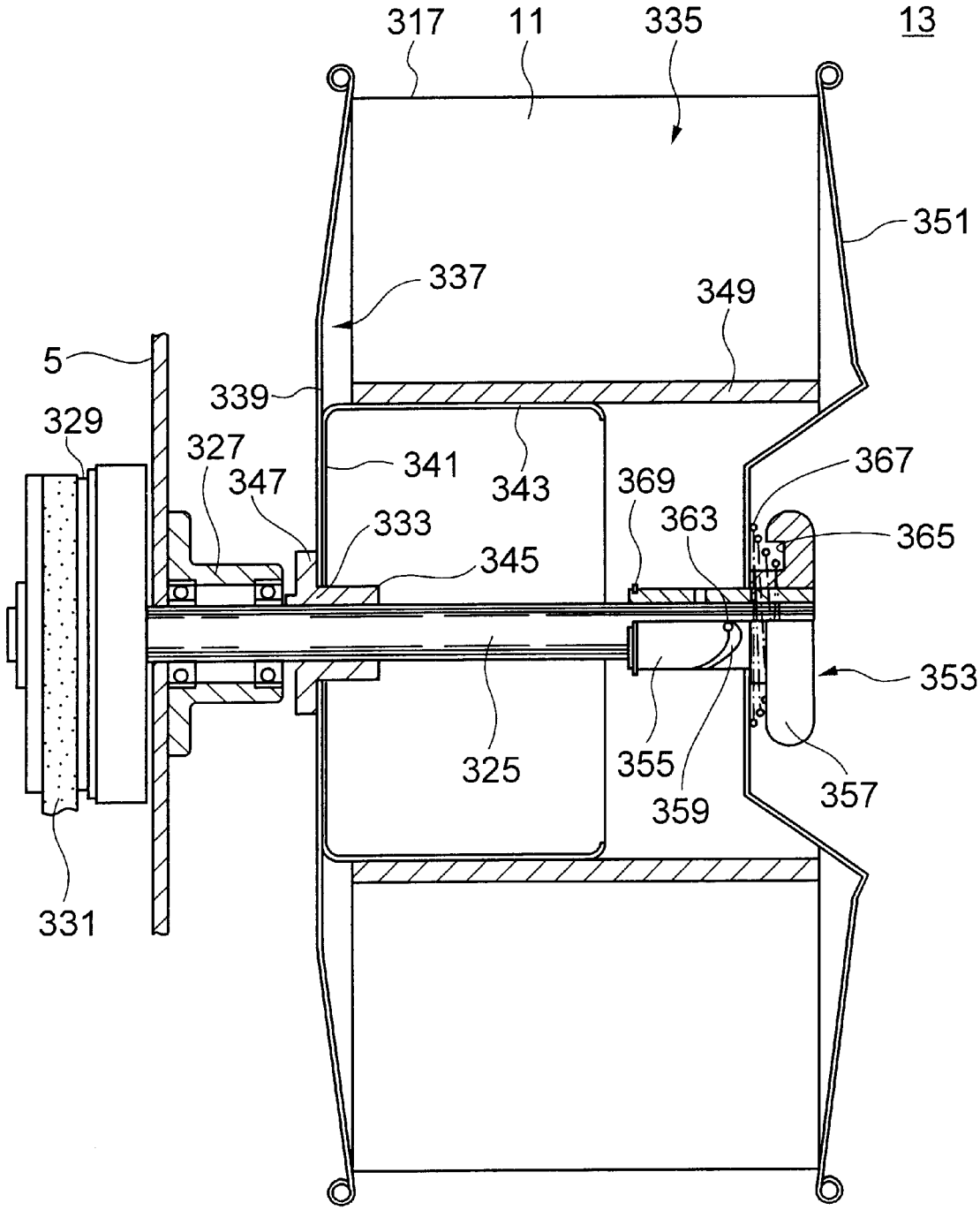
FIG. 14 is a vertically cross-sectional view showing the structure of a band reel.
Figure 15:
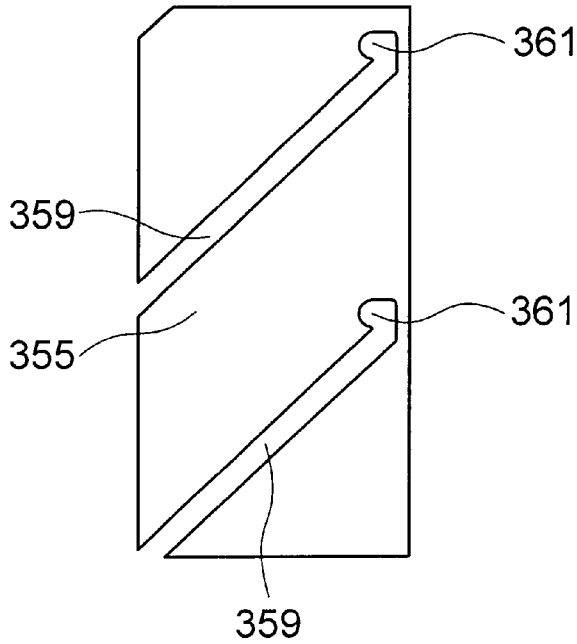
FIG. 15 is a diagram showing the cylindrical portion of a nob with a guide groove in an developed state.
Figure 16:
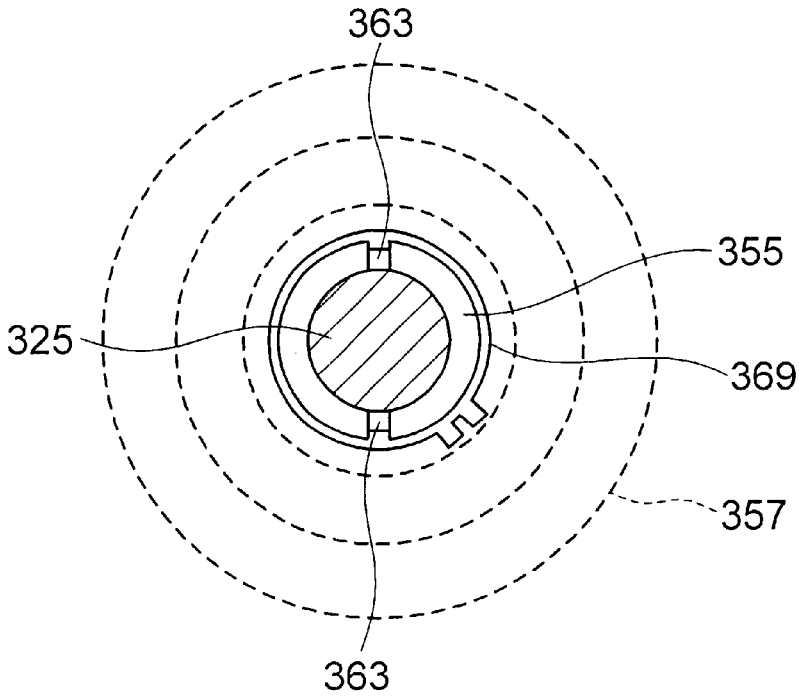
FIG. 16 is a cross-sectional view showing a state of engagement of pins formed in a supporting shaft.

FIG. 14 is a vertically cross-sectional view showing the entire structure of a band reel 13 for a strapping band; FIG. 15 is a diagram in a developed state of a portion in which guide grooves are formed in a cylindrical portion of a nob, wherein the shape of the guide grooves is shown, and FIG. 16 is a cross-sectional view showing a state of engagement of pins of a supporting shaft.

A top end portion of a supporting shaft 325 (a side of the main body 5 of the strapping machine 1 is referred to as a top end side or a front side, and the opposite side thereof, i.e., a free end side is referred to as a rear end side or a rear side) which supports a band reel 13, is provided with a bearing 327 which is fixed to the main body of the arch type strapping machine 1. The top end portion of the supporting shaft 325, which extends beyond the bearing 327 into the main body 5 is fixed with a pulley 329 which is connected to an electromagnetic brake (not shown) by means of belt 331.

A collar 333 is fixed to a rear side of the supporting shaft 325 with respect to the bearing 327. The main body 337 of a reel portion 335 is connected to the collar 333. The main body 337 comprises a side plate 339 (a front side plate) made of a thin metallic plate in which a fitting hole is formed at the center and an annular body portion 343 made of a thin metallic plate. The annular body portion 343 has, at its an end (front end), a bottom portion 341 having a fitting hole at its center, fixed to the side plate 339 and at its other side (a rear side), an opening having a smaller diameter than the fitting hole of the side plate 339. A cylindrical portion 345 of the collar 333 is inserted into the fitting hole of the side plate 339 and the fitting hole of the bottom portion 341. On the other hand, the side plate 339 and the bottom portion 341 are fixed to a flange portion 347 of the collar 333. Thus, the main body 337 of the reel portion 335 is attached fixedly to the collar 333, i.e., the supporting shaft 325.

The reel portion 335 is adapted to fit a band roll 317, in which the strapping band 11 is wound around a core member 349, to an outer circumference of the annular body portion 343 and to attach the side plate 339 and the other side plate 351 (a rear side plate) to the supporting shaft 325 so that the strapping band 11 is held between both the side plates 339, 351. The rear side plate 351 is assembled to the nob 353 (or a cap). Namely, the rear side plate 351 is attached to the supporting shaft 325 by fixing the nob 353 to the supporting shaft 325.

The nob 353 comprises a cylindrical portion 355 to which a rear end portion of the supporting shaft 325 can be fitted and a handle portion 357 fixed to a rear end of the cylindrical portion 355. The rear side plate 351 is assembled to the nob 353 by inserting the cylindrical portion 355 into a fitting hole formed at the center of the rear side plate 351. In the cylindrical portion 355 of the nob 353, two guide grooves 359 extending spirally from its front end portion to the rear portion at a distance of 180° wherein a recess 361 recessed in a front direction (or extending slightly in a front direction) is formed at a rear end of each of the guide grooves 359. Two pins 363 are also formed in a rear portion of the supporting shaft 325 at a distance of 180° so as to correspond to the guide grooves 359. The height of the pins 363 is slightly lower than the thickness of the cylindrical portion 355. An annular groove 365 is formed in a rear side surface of the handle portion 357 of the nob 353, and a head portion of a compression coil spring 367 having a truncated cone shape is fitted to the annular groove 365 so that the rear side plate 351 is pressed toward the band roll 317 whereby the band roll 317 is held between the both side plates 339, 351. In FIG. 14, reference numeral 369 designates a C-ring which prevents the rear side plate 351 from coming off.

In order to attach the nob 353 to the supporting shaft 325, each opening formed at the top end of the guide grooves 359 of the nob 353 is made coincident with each of the pins 363 of the supporting shaft 325 (FIG. 16 shows such state), and the nob 353 is pushed to the shaft. Then, the nob 353 is moved forwardly while rotating around its own axis whereby it can be fitted to the supporting shaft 325. When the pins 363 reach the rear end portion of the guide grooves 359, the rotation and the advance of the nob 353 are stopped. However, before the movement of the nob 353 is stopped, the band roll 317 comes to contact with the outer circumference and so on of the rear side plate 351, and the compression coil spring 367 is compressed between the rear side plate 351 and the nob 353 at the time of the completion of pushing the nob 353. Accordingly, when the pushing force to the nob 353 is removed, the nob 353 is moved in a direction of coming-off from the supporting shaft 325 (i.e., a rear direction) by the spring action of the compression coil spring 367 compressed between the nob 353 and the rear side plate 351. As a result, the pins 363 are fitted to the recesses 361 so that the nob 353 is engaged with the supporting shaft 325 so as not to cause the rotation. When the nob 353 is to be removed from the supporting shaft 325, the nob 353 should be pushed against the spring action of the compression coil spring 367 to disengage the pins 363 from the recesses 361, and the nob 353 is pulled while rotated slightly. Thus, the nob 353 can be disengaged from the supporting shaft 325 under the rotation.

Thus, in the above-mentioned embodiment, the nob can be fitted to the supporting shaft by making the openings of guide groove coincident with the pins and pushing the nob, whereby the nob is advanced according to the relative movement and rotation of the pins with respect to the guide grooves. When the pins reach the rear end (i.e., inlets of recess) of the guide grooves, the movement of the nob is stopped. In this case, the nob is moved in a rear direction by weakening the pushing force to the nob since the nob is urged in a rear direction (a direction capable of coming-off from the supporting shaft) by the spring member disposed between the nob and the reel portion. As a result, the pins are fitted to the recesses whereby the nob can be fixed to the supporting shaft in a non-rotatable manner.

In a preferred embodiment of the present invention, the rear side plate of the reel portion is attached to the nob (in many cases, the side plate is assembled to the cylindrical portion of the nob). Then, the assembling or disassembling of the side plate can be conducted together with the removal or the attachment of the nob.

In order to obtain a certain fixing state of the nob to the supporting shaft, it is preferable to form two guide grooves and recesses and two pins in correspondence with the guide grooves.

As described above, in accordance with the arch type strapping machine having the sealing mechanism of the present invention, one continuous revolution of the shaft for sealing having a cam for driving can be performed without stopping it. Accordingly, the steps of cutting and melt-bonding of the strapping band can be conducted quickly.

Further, according to the arch type strapping machine having the driving mechanism for the strapping band, the band feeding step, the first and second tightening steps can be performed by only the rotation and driving of the band driving roller. Accordingly, the size of the strapping machine can be reduced.

Further, according to the arch type strapping machine having the band driving-out mechanism of the present invention, the remaining of the strapping band in the groove of the band guide at the time of opening the band guide can be prevented. Further, the push pin can follow the movement of the band guide even when the band guide shakes at the time of opening of the band guide. Accordingly, a smooth opening operation of the band guide can be maintained.

Further, according to the arch type strapping machine provided with the band reel for the strapping band of the present invention, the replacement of band rolls can quickly and simply be conducted. The entire disclosures of Japanese Patent Application No. 2001-110233 filed on Apr. 9, 2001, Japanese Patent Application No. 2001-110234 filed on Apr. 9, 2001, Japanese Patent Application No. 2001-112059 filed on Apr. 10, 2001 and Japanese Patent Application No. 2001-112060 filed on Apr. 10, 2001 including specifications, claims, drawings and summaries are incorporated herein by reference in their entireties.

What is claimed is:

1. An arch type strapping machine comprising a sealing mechanism which comprises a right gripper for fixing a top end of a strapping band fed into a band guide of the arch type strapping machine, a left gripper for fixing a rear portion of the strapping band after the strapping band has been wound around an article to be strapped and tightened, a compression head for compressing and bonding the top end and the rear portion of the strapping band and cutting the rear portion of the band, a first driving device configured to drive the right gripper, and a second driving device configured to drive the left gripper and the compression head, wherein the second driving device comprises a motor for sealing, a shaft for sealing rotated by the motor, a cam for fixing attached to the shaft for sealing to operate the left gripper, and a cam for bonding to operate the compression head.

2. The arch type strapping machine according to claim 1, wherein the sealing mechanism comprises a band guide driving section which is operated separate from the second driving device, and opens forcibly the band guide.

3. The arch type strapping machine according to claim 1, wherein the first driving device comprises a solenoid plunger for operating the right gripper.

4. The arch type strapping machine according to claim 2, wherein the band guide driving section comprises a solenoid plunger for opening the band guide.

5. An arch type strapping machine comprising a sealing mechanism which comprises a right gripper for fixing a top end of a strapping band fed into a band guide of the arch type strapping machine, a left gripper for fixing a rear portion of the strapping band after the strapping band has been wound around an article to be strapped and tightened, a compression head for compressing and bonding the top end and the rear portion of the strapping band and cutting the rear portion of the band, first driving means for driving the right gripper, and second driving means for driving the left gripper and the compression head.

6. A sealing mechanism for an arch type strapping machine, comprising:

a right gripper configured to fix a top end of a strapping band fed into a band guide of the arch type strapping machine;

a left gripper configured to fix a rear portion of the strapping band after the strapping band has been wound around an article to be strapped and tightened;

a compression head configured to compress and bond the top end and the rear portion of the strapping band and cut the rear portion of the band;

a first driving device configured to drive the right gripper; and a second driving device configured to drive the left gripper and the compression head, wherein the second driving device comprises a motor for sealing, a shaft for sealing rotated by the motor, a cam for fixing attached to the shaft for sealing to operate the left gripper, and a cam for bonding to operate the compression head.

7. The sealing mechanism for an arch type strapping machine according to claim 6, further comprising a band guide driving device configured to operate independently from the second driving device and open the band guide.

8. The sealing mechanism for an arch type strapping machine according to claim 7, wherein the band guide driving device comprises a solenoid plunger device.

9. The sealing mechanism for an arch type strapping machine according to claim 6, wherein the first driving device comprises a solenoid plunger device.

* * * * *